US011319135B2

(12) United States Patent
Kieling et al.

(10) Patent No.: US 11,319,135 B2
(45) Date of Patent: May 3, 2022

(54) FOOD STORAGE CONTAINER

(71) Applicant: PACKIT, LLC, Westlake Village, CA (US)

(72) Inventors: Melissa Kieling, Westlake Village, CA (US); Roland Ecarma, Westlake Village, CA (US); Kate Abdelmalek, Santa Monica, CA (US); Scot Herbst, Santa Cruz, CA (US); Will Hunter, Santa Cruz, CA (US); Eamonn Kelly, Santa Cruz, CA (US)

(73) Assignee: Packit, LLC, Westlake Village, CA (US)

( * ) Notice: Subject to any disclaimer, the term of this patent is extended or adjusted under 35 U.S.C. 154(b) by 437 days.

(21) Appl. No.: 16/146,509

(22) Filed: Sep. 28, 2018

(65) Prior Publication Data

US 2019/0100370 A1 Apr. 4, 2019

Related U.S. Application Data

(60) Provisional application No. 62/566,127, filed on Sep. 29, 2017.

(51) Int. Cl.
*B65D 81/32* (2006.01)
*B65D 43/02* (2006.01)
(Continued)

(52) U.S. Cl.
CPC ..... *B65D 81/3216* (2013.01); *A45C 11/20* (2013.01); *B65D 25/06* (2013.01);
(Continued)

(58) Field of Classification Search
CPC .... B65D 81/3216; B65D 25/06; B65D 25/24; B65D 43/0214; B65D 43/162; B65D 45/20
(Continued)

(56) References Cited

U.S. PATENT DOCUMENTS 630,835 A 8/1899 Adams, Jr.
2,788,912 A * 4/1957 Simonsen ..... B65D 25/06 220/533
(Continued)

FOREIGN PATENT DOCUMENTS

CN 2584018 Y 9/2002
CN 201647313 U 11/2010
(Continued)

OTHER PUBLICATIONS

US Plastic—Akro-Mils Multi-Load Tote, Cups, Aug. 28, 2018—www.usplastic.com/catalog/item.aspx?itemid= 102594&catid=537.
(Continued)

*Primary Examiner* — J. Gregory Pickett
*Assistant Examiner* — Abigail Elizabeth Guidry
(74) *Attorney, Agent, or Firm* — Vedder Price P.C.

(57) ABSTRACT

A configurable container is provided that has an interior surface configured to secure one or more rigid or flexible dividers and to allow for reconfigurable interior compartments of the container. The dividers may also include an integrated material such as a gel that can be heated or cooled in order to maintain a desired temperature within the container. The container may include a lid that engages the top surfaces of the dividers to establish a plurality of substantially sealed compartments within the container.

20 Claims, 14 Drawing Sheets

(51) Int. Cl.

| | |
|---|---|
| ***B65D 55/02*** | (2006.01) |
| ***B65D 53/00*** | (2006.01) |
| ***B65D 43/16*** | (2006.01) |
| ***B65D 25/06*** | (2006.01) |
| ***B65D 25/24*** | (2006.01) |
| ***B65D 51/24*** | (2006.01) |
| ***B65D 51/16*** | (2006.01) |
| ***B65D 45/20*** | (2006.01) |
| ***A45C 11/20*** | (2006.01) |
| ***B65D 25/20*** | (2006.01) |
| *A45C 13/02* | (2006.01) |

(52) U.S. Cl.
CPC ..... *B65D 25/20* (2013.01); *B65D 25/24* (2013.01); *B65D 43/0214* (2013.01); *B65D 43/162* (2013.01); *B65D 45/20* (2013.01); *B65D 51/1672* (2013.01); *B65D 51/1683* (2013.01); *B65D 51/246* (2013.01); *B65D 53/00* (2013.01); *B65D 55/02* (2013.01); *A45C 2013/026* (2013.01)

(58) Field of Classification Search
USPC ..... 220/577, 592.01, 592.02, 592.2, 592.21, 220/495.01, 500, 529, 532, 203.01, 551
See application file for complete search history.

(56) References Cited

U.S. PATENT DOCUMENTS

| | | | | |
|---|---|---|---|---|
| 3,079,028 | A | 2/1963 | Rosner | |
| 3,200,983 | A * | 8/1965 | Walter | A47B 88/975 220/533 |
| 3,391,816 | A * | 7/1968 | Swett | B65D 43/0218 220/534 |
| 4,593,816 | A * | 6/1986 | Langenbeck | B65D 25/06 206/425 |
| 4,779,752 | A * | 10/1988 | Vallee | B42F 17/08 220/533 |
| 5,244,268 | A | 9/1993 | Derrickson | |
| 5,553,710 | A * | 9/1996 | Takama | A47B 88/90 206/561 |
| 5,641,065 | A * | 6/1997 | Owens | B65D 45/20 206/363 |
| 5,704,485 | A * | 1/1998 | Cautereels | B65D 1/22 206/546 |
| 5,806,708 | A | 9/1998 | Schwab | |
| 6,938,793 | B2 * | 9/2005 | Lerner | A47J 36/2494 220/574.2 |
| 7,090,089 | B2 * | 8/2006 | Lown | B65D 43/0218 220/324 |
| 7,607,540 | B2 | 10/2009 | Ballard | |
| 7,614,522 | B2 * | 11/2009 | Hsu | A47J 36/06 220/367.1 |
| 7,828,457 | B2 | 11/2010 | Davidoff | |
| 7,984,820 | B2 | 7/2011 | Dancyger | |
| 8,479,947 | B1 | 7/2013 | Albrecht, II | |
| 8,573,002 | B2 | 11/2013 | Ledoux et al. | |
| 8,844,756 | B2 | 9/2014 | Beyburg | |
| 9,108,790 | B2 * | 8/2015 | Daley | A47J 47/005 |
| 2002/0096525 | A1 | 7/2002 | Bertoldo et al. | |
| 2003/0116572 | A1 * | 6/2003 | Klock | B65D 51/1683 220/367.1 |
| 2004/0188204 | A1 | 9/2004 | Wilkins-Langie | |
| 2009/0134169 | A1 * | 5/2009 | Christenson | B65D 25/06 220/553 |
| 2009/0223971 | A1 | 9/2009 | Moffett | |
| 2010/0084443 | A1 | 4/2010 | Adelman | |
| 2010/0237070 | A1 * | 9/2010 | Coonce | B65D 81/2038 220/203.29 |
| 2010/0263399 | A1 | 10/2010 | Pollina | |
| 2010/0307878 | A1 | 12/2010 | Giglio | |
| 2014/0103033 | A1 * | 4/2014 | Beckman | B65D 43/0212 220/4.01 |
| 2014/0183190 | A1 * | 7/2014 | Tyberghein | B65D 25/10 220/23.89 |
| 2014/0238995 | A1 * | 8/2014 | Vargas | B65D 25/06 220/523 |
| 2015/0369529 | A1 | 12/2015 | Monroe | |
| 2016/0060004 | A1 | 3/2016 | Dunn et al. | |
| 2016/0325885 | A1 * | 11/2016 | Plattner | B65D 5/48 |
| 2017/0233139 | A1 * | 8/2017 | Averill | B65D 25/06 220/533 |
| 2017/0290400 | A1 | 10/2017 | Thomas | |
| 2018/0030704 | A1 * | 2/2018 | Bomatter | F16J 15/10 |
| 2018/0094853 | A1 | 4/2018 | McCurry | |
| 2018/0265267 | A1 * | 9/2018 | Arenas | B65D 53/02 |
| 2019/0127127 | A1 * | 5/2019 | Aznar | B65D 25/04 |

FOREIGN PATENT DOCUMENTS

| | | | |
|---|---|---|---|
| CN | 202244458 | U | 5/2012 |
| CN | 103385589 | A | 11/2013 |
| EP | 2319351 | | 5/2011 |
| GB | 2546125 | | 6/2016 |
| GB | 2546125 | A | 12/2017 |
| JP | 359078228 | | 5/1984 |
| JP | 2012095913 | A | 5/2012 |
| WO | 2018144092 | A2 | 8/2018 |
| WO | WO2018144092 | | 8/2018 |

OTHER PUBLICATIONS

International Preliminary Report on Patentability and Written Opinion filed in PCT/US2018/053501; dated Mar. 31, 2020; 9 pages.
International Search Report dated Jan. 16, 2019 issued in connection with PCT/US2018/053501; 6 pages.
International Written Opinion dated Jan. 16, 2019 issued in connection with PCT/US2018/053501; 8 pages.
US Plastic—Akro-Mils Multi-Load Tote, Cups, Aug. 28, 2018—www.usplastic.com/catalog/item.aspx?temid=1025948catid=537.
Packir—PK-86A: Backpack Food Delivery Bag with Dividers, w/3 partitions for hot/cold, 16"L x 13"W x 24"H, Aug. 28, 2018—www.amazon.com/PK-86A-Backpack-Delivery-Dividers-Partitions/dp/B01ibysgse.
Liubella—Deluxe Makeup Organizer Bag Traveling Cosmetic Storage Box with Easy Adjustable Dividers, Aug. 28, 2018—www.amazon.com/makeup-organizer-customizable-dividers-scratch-resistant/DPb075cphg1h?TH=1.
CCPIT Patent and Trademark Office; Notification of First Office Action filed in Application No. 201880076971.0 dated Jul. 8, 2021; 10 pgs.
United States Plastic Corp.; Akro-Mils Multi-Load Tote, Cups; Aug. 28, 2018; 2 pages.
LiuBella; Amazon.com; Deluxe Makeup Organizer Bag; Aug. 28, 2018; 8 pages.
Packir; Amazon.com; PK-86A Backpack Food Delivery Bag with Dividers; Aug. 28, 2018; 6 pages.
Extended European Search Report dated Aug. 4, 2021 in Application No. 18862540.4; 9 pages.

* cited by examiner

FOOD STORAGE CONTAINER

CROSS-REFERENCE TO RELATED APPLICATIONS

This application claims the benefit of and priority from U.S. Provisional Application Ser. No. 62/566,127, filed on Sep. 29, 2017, the contents of which are hereby fully incorporated herein by reference in their entirety.

FIELD OF THE INVENTION

The present invention generally relates to containers and methods of using same, and more specifically relates to modular containers for use in storing and transporting items such as food and drinks, including containers having modular rigid and/or flexible dividers therein.

BACKGROUND

Self-supporting multipurpose containers and coverings are used for packing, storing, and transporting food, beverages, and other items that need to kept separate from other items. Existing containers do not provide meaningful versatility and can generally be used only in a few configurations. Existing containers that have multiple compartments are generally incapable of being adjusted, forcing users to employ nonoptimal arrangements that may not suit the items the user wishes to transport. For example, existing containers generally contain one or more pre-defined compartments; users are unable to adjust the configuration of compartments based on the specific item(s) to be transported or stored therein. Alternatively, users may be forced to place different types of items in separate packaging (such as separate plastic bags) in order to keep the items separated within a container. The use of separate packaging is wasteful (as where the packaging is single-use or disposable) and does not adequately retain items within a desired portion of the container.

What is needed is an improved container and a method of using the same to permit the transport of multiple items in separate compartments within a container that may be rearranged to a variety of configurations. The device and related methods described in the present disclosure address the drawbacks of existing designs.

SUMMARY

Described herein are containers that have an interior surface configured to secure a rigid or flexible divider in a variety of configurations so as to allow for a reconfigurable interior of the container. The dividers may also include an integrated material such as a gel that can be heated or cooled in order to maintain a desired temperature within the container. The containers also include a lid with an inside surface extending down to engage a top surface of the dividers and thereby establish a plurality of substantially sealed compartments within the container.

Embodiments described herein provide a configurable container that has an interior surface configured to secure one or more rigid or flexible dividers and to allow for reconfigurable interior compartments of the container. The dividers may also include an integrated material such as a gel that can be heated or cooled in order to maintain a desired temperature within the container. The container may include a lid that engages the top surfaces of the dividers to establish a plurality of substantially sealed compartments within the container.

In an embodiment, a container system is provided that comprises a container comprising: a base wall; a peripheral wall extending from the base wall to form a cavity, the peripheral wall comprising a top edge opposite the base wall; and a pair of ridges separated by a groove, the pair of ridges and the groove extending across the base wall and at least a lower portion of the peripheral wall proximate the base wall; and a divider comprising an edge, the edge sized so as to fit within the groove between the pair of ridges.

In another embodiment, a container system is provided comprising: a container comprising a base wall and a peripheral wall extending from the base wall to form a cavity, the peripheral wall comprising a top edge opposite the base wall and at least one first engagement mechanism; and a divider comprising at least one second engagement mechanism, the second engagement mechanism configured to detachably connect to the first engagement mechanism so as to secure the divider within the container.

Other features and advantages of the present invention will become more readily apparent to those of ordinary skill in the art after reviewing the following detailed description and accompanying drawings.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
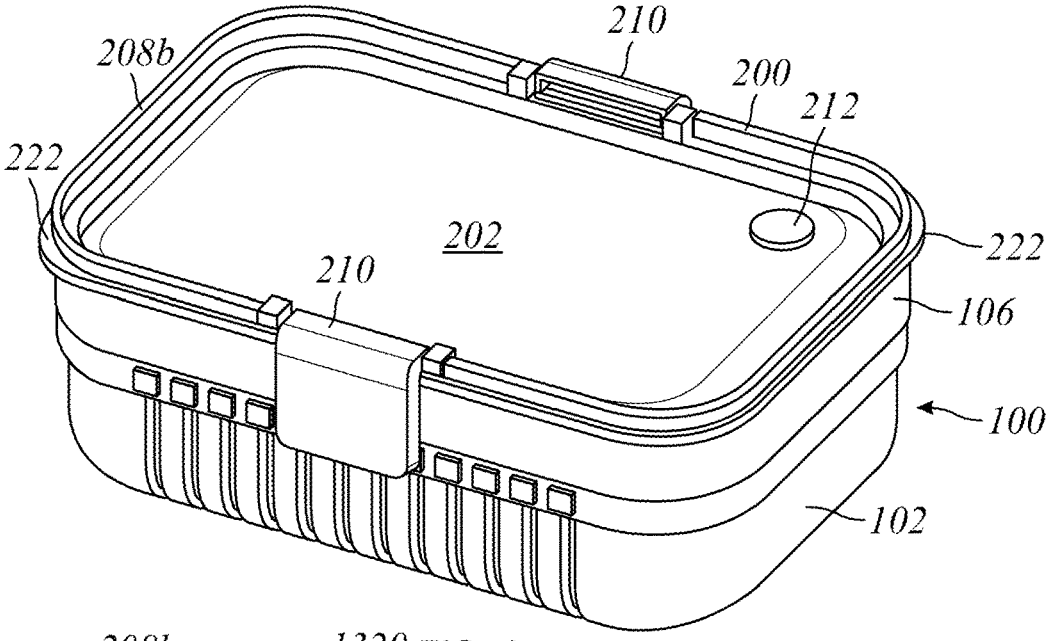
FIG. 1 is a perspective view of a first embodiment of a container with a lid.
Figure 2:
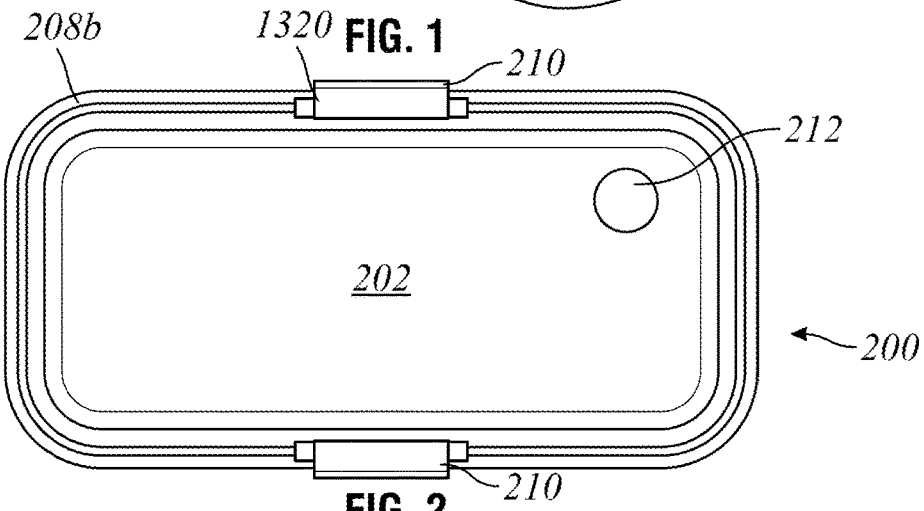
FIG. 2 is a top view of the container of FIG. 1.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of skill in the art to which this disclosure relates.

FIGS. 1 through 13 depict a first embodiment of a container 100 for storing and transporting items, such as food and beverages. The container 100 comprises a base 102 and a lid 200.

The base 102 comprises a floor 104 and a perimeter wall 106 extending upward from the floor 104 to define a cavity. Items to be stored or transported may be placed within the cavity in the base 102. The interior surface 108 of the base 102 comprises a plurality of alternating grooves 110 and ridges 112 which stretch the width of the floor 104 and along at least a portion of the peripheral wall 106. A plurality of spaced apart indentations 114 extend along the interior surface 108 of the peripheral wall 106 above the grooves 110 and ridges 112. In an embodiment, a ridge 115 extends around the peripheral wall 106 above the plurality of indentations 114.

The exterior surface 116 of the base 102 may be generally smooth. Alternatively, the exterior surface 116 may mirror the structure of the interior surface 108, for example by including protrusions corresponding to the plurality of grooves 110 and indentations corresponding to the plurality of ridges 112. As shown, a plurality of feet 118 may extend away from the exterior surface 116 of the floor 104 of the base 102 so as to support the base 102 above a surface (not shown).

The lid 200 is sized so as enclose the cavity in the base 102. The lid 200 comprises a top surface 202 opposite a bottom surface 204 that are separated by an exterior wall 206. As shown, the exterior wall 206 may extend downwards past the bottom surface 204 so as to form a lower peripheral ridge 208*a* configured to engage with the peripheral wall 106 of the base 102 and form an airtight seal. A gasket 226 on the lower peripheral ridge 208*a* is located so as to contact the peripheral wall 106 when the lid 200 is attached to the base 102. Engagement mechanisms 210 are located on the exterior wall 206 of the lid 200 and are configured to interlock with corresponding receiving portions 120 located on the exterior surface 116 of the peripheral wall 106 of the base 102, thereby securing the lid 200 to the base 102 and sealing the container 100. As shown, the engagement mechanisms 210 are rotably attached to the lid 200; to lock the lid 200 to the base 102, the lid 200 is pressed firmly against the base 102, causing the gasket 226 to depress. In an embodiment, the receiving portions 120 comprise indentations beneath a protrusion or teeth that hold the engagement mechanism in place. The engagement mechanisms 210 are rotated such that they interlock with the corresponding receiving portions 120, and pressure is removed from the lid 200. To remove the lid 200, the process is reversed: pressure is applied to the lid 200, causing the engagement mechanisms 210 to disengage from the corresponding receiving portions 120. The engagement mechanisms 210 are then rotated away from the receiving portions 120, and pressure is removed from the lid 200. The lid 200 can then be lifted off the base 102. In an alternative embodiment, a gasket 226 is not used, and the lid 200 itself is made from a resilient material capable of deforming to form an airtight seal against the base 102.

In an embodiment, the exterior wall 206 of the lid 200 also extends above the top surface 202 of the lid 200, such that an upper peripheral ridge 208*a* also extends above the top surface 202 of the lid 200. One or more tabs 222 may extend laterally away from the exterior wall 206 of the lid 200 so as to permit the lid 200 to be easily removed from the container 100 by applying upward force to one or more of the tabs 222 once the engagement mechanisms 210 are disengaged. As shown a single tab 222 may be located at a corner of the lid 200. Alternatively, tabs 222 may be located at each corner of the lid or on other portions of the lid 200.

Figure 3:
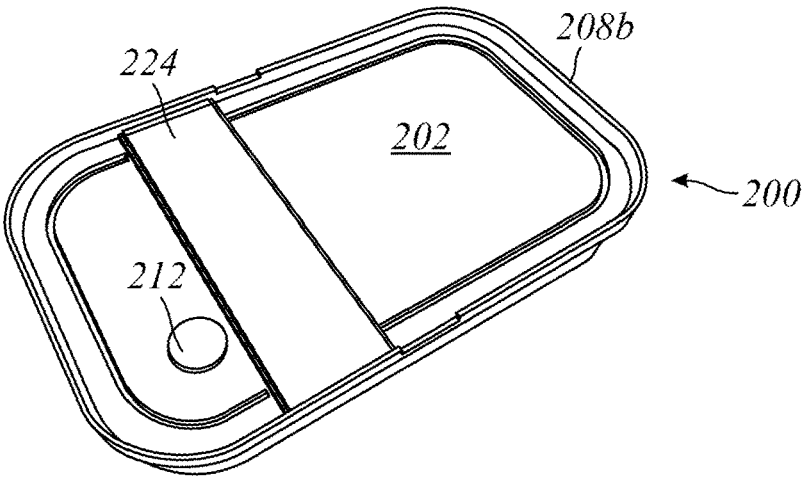
FIG. 3 is an alternative embodiment of a lid for the container of FIG. 1.
Figure 4:
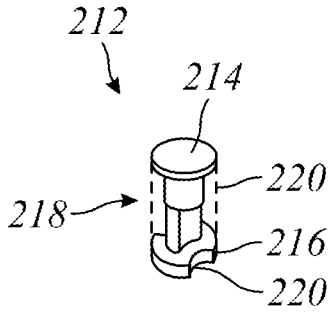
FIG. 4 is perspective view of the vent shown in FIG. 1.
Figure 5:
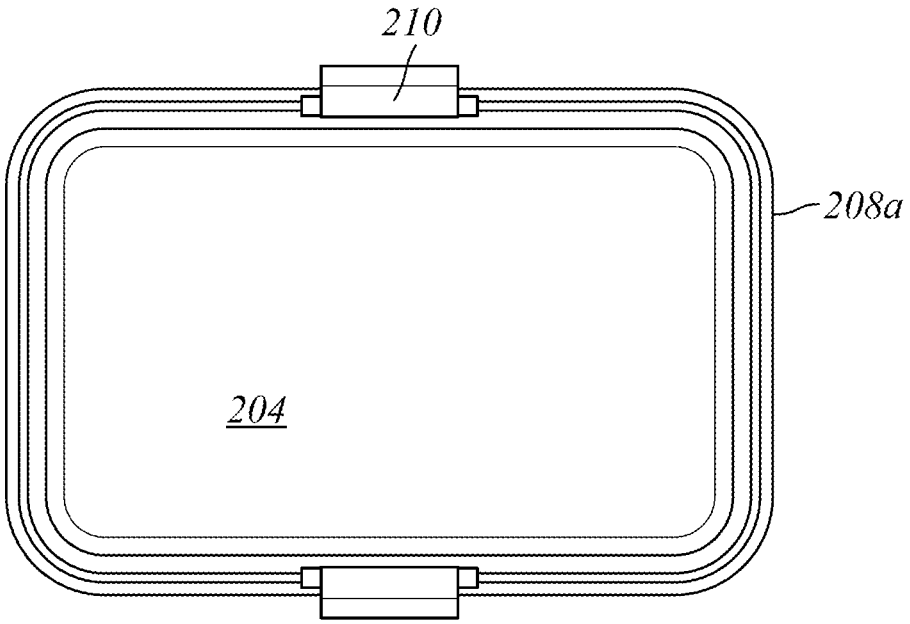
FIG. 5 is a bottom view of a lid of FIG. 1 without the vent.
Figure 6:
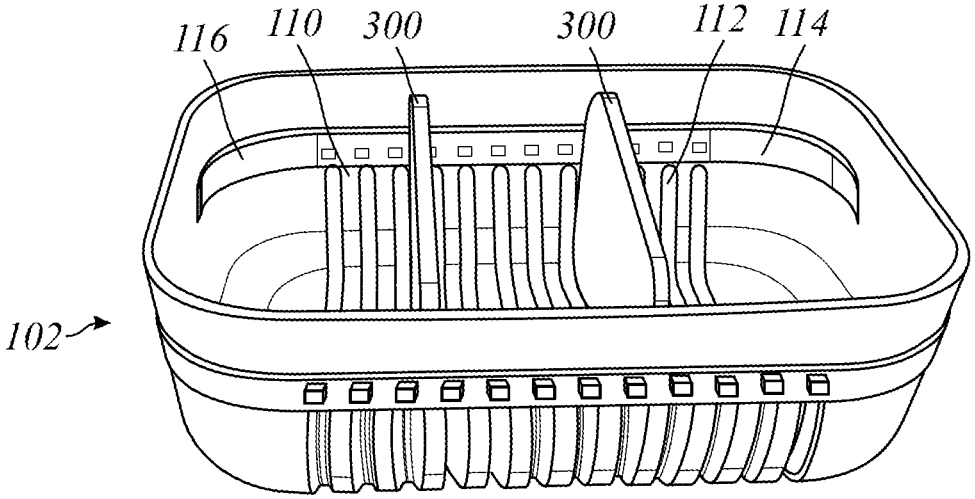
FIG. 6 is a top perspective view of the container of FIG. 1 with the lid removed.
Figure 7:
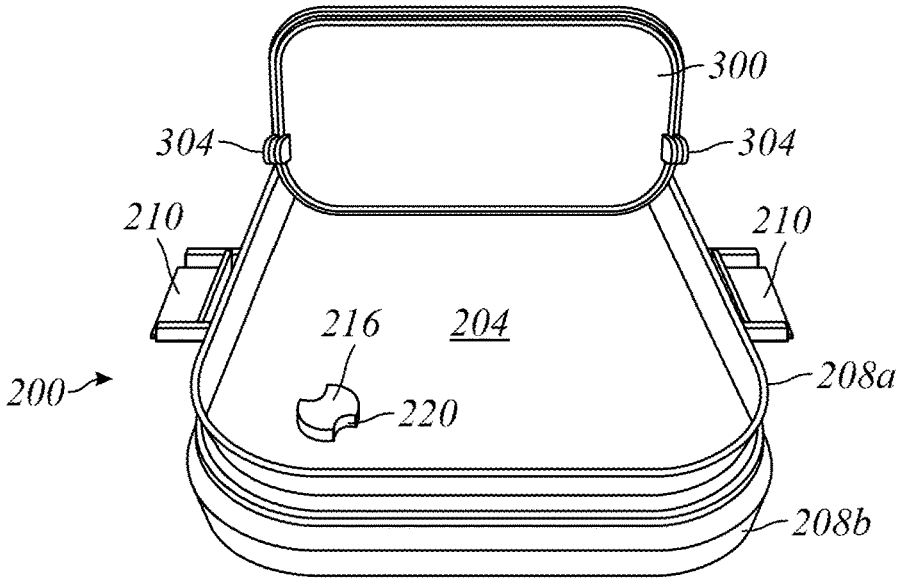
FIG. 7 is a bottom perspective view of the lid of FIG. 1 with a divider.
Figure 8:
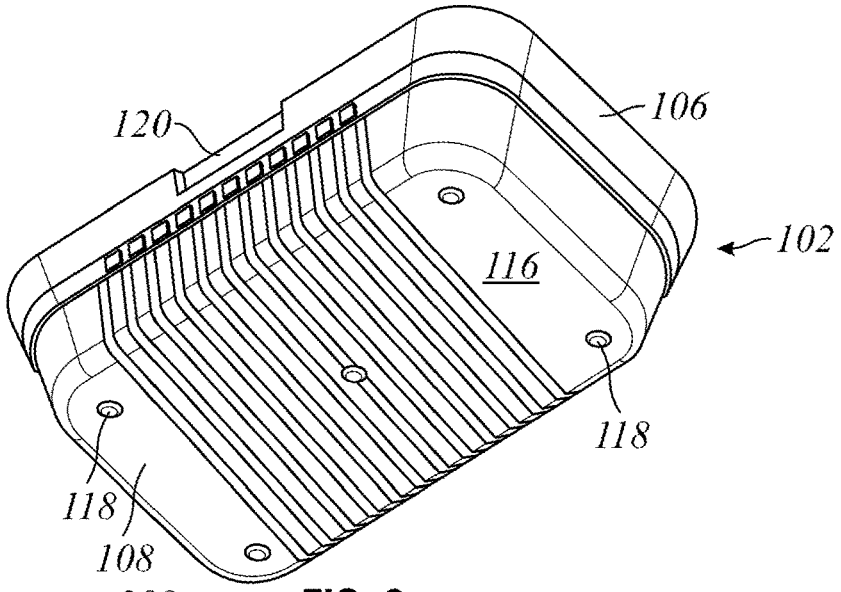
FIG. 8 is a bottom perspective view of the container of FIG. 1.
Figure 9:
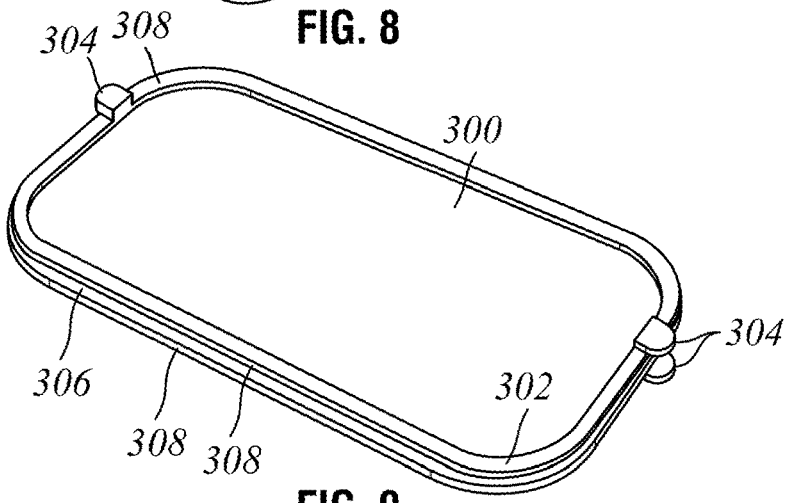
FIG. 9 is a perspective view of a divider.
Figure 10:
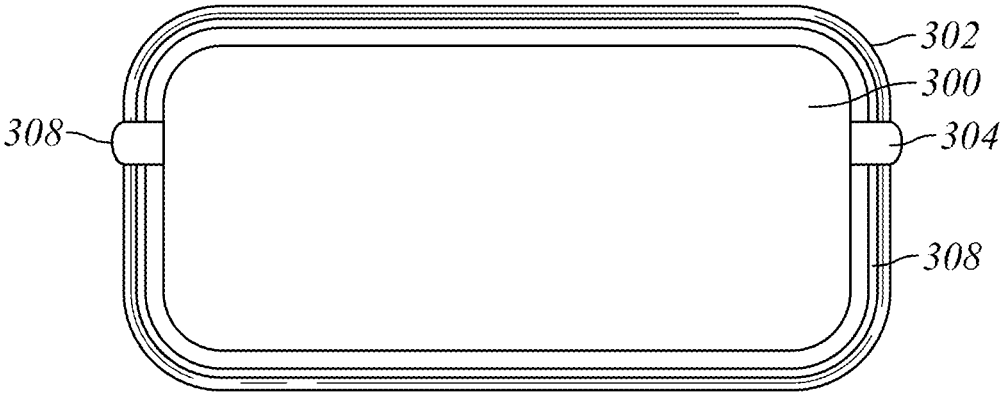
FIG. 10 is a side view of the divider of FIG. 9.

As shown in FIG. 3, a strap 224 may be attached to top surface 202 of the lid 200 so as to secure items such as utensils or napkins to the lid 200 for easy transport with the container 100. By locating the items outside the container 100, they are kept separate from the food or other items that are stored therein. As shown, the strap 224 may extend between opposing portions of the upper peripheral ridge 208. The strap 224 may be made from a semirigid or elastic material such as silicon or plastic, such that the strap 224 can flex away from the lid 200 so as to permit objects of various sizes to be held between the lid 200 and the strap 224. The strap 224 may be formed as an integral part of the lid 200, fixedly attached to the lid 200 (e.g., using glue or overmolding), or may be removably attached to the lid 200 (e.g., using snap-locks). In an embodiment, a plurality of straps are used, either in a parallel or an overlapping arrangement. The straps may be slidably attached to the lid 200 via a track (not shown) on the upper peripheral ridge 208*a*, thereby permitting the positions of the straps to be adjusted (e.g., to hold multiple items or items of different sizes).

In an embodiment, the lid 200 further comprises a vent 212. An opening (not shown) is formed in the lid 200, and the vent 212 passes through the opening, with an outer section 214 of the vent 212 located proximate the top surface 202 of the lid 200, an inner section 216 of the vent 212 located proximate the bottom surface 204 of the lid 202, and a transverse section 218 extending therebetween through the opening. The outer section 214 and the inner section 216 are both larger than the opening, while the transverse section 218 is sized to fit within the opening, such that the vent 212 is movably attached to the lid 200. The length of the transverse section 218 is greater than the thickness of the lid 200, such that the outer section 214 and the inner section 216 of the vent 212 are incapable of both contacting the lid 200 simultaneously. As shown, the opening is circular. The transverse section 218 has a corresponding circular cross section, with the portion proximate the outer section 214 exactly matching the shape of the opening and a channel 220 beginning at the junction between the transverse section 218 and the inner section 216 and terminating a short distance from the outer section 214. The diameter of the transverse section 218 proximate the outer section 214 may be slightly larger than the size of the opening so as to form an airtight seal with the opening when the outer section 214 is in contact with the top surface 202 of the lid 200. To close the vent 212, the outer section 214 is pressed downwards such that the channel 220 does not extend the length of the opening. To open the vent 212, the outer section 214 is lifted upwards away from the lid 200 such that the channel 220 extends the length of the opening. The friction between the transverse section 218 and the lid 200 is sufficient to hold the vent 212 in place.

As shown, one or more dividers 300 may be placed within the container 100 so as to form distinct compartments. Each divider 300 includes a rim 302 sized to fit within one of the grooves 110 between ridges 112 in the base 102 of the container 100, thereby securing the divider 300 in place. Tabs 304 protrude from opposite sides of the rim 302 and are configured to engage with opposite indentations 114 in the peripheral wall 106 of the base 102 so as to secure the divider 300 in place. In alternative embodiments, only tabs 304 are used to hold the divider 300 in place (and the grooves 110 and ridges 112 may be omitted from the base). Alternatively, the tabs 304 may be omitted from the divider 300, and the divider 300 may be secured simply by inserting the rim 302 into a groove 110. A gasket 306 may be placed along the rim 302 such that the gasket 306 contacts the interior surface 108 of the base 102 when the divider 300 is placed in the base 102. This permits the divider 300 to form an airtight and watertight seal between adjacent portions of the cavity. In the embodiment shown, the gasket 306 is placed between a pair of raised edges or walls 308.

In the embodiment shown, the bottom surface 204 of the lid 200 is formed so as to engage the rim 302 of the divider 300, thereby forming a seal with the divider 300. In an alternative embodiment, corresponding grooves and ridges are also formed on the bottom surface 204 of the lid 200 so as to more completely engage with dividers 300 within the container 100. These grooves and ridges may be molded into the bottom surface 204 of the lid 200 so as to be integral parts of the lid 200. Alternatively, the grooves and ridges may be formed as separate pieces that are joined to the lid 200 using glue, adhesive, or another attachment mechanism.

Figure 11:
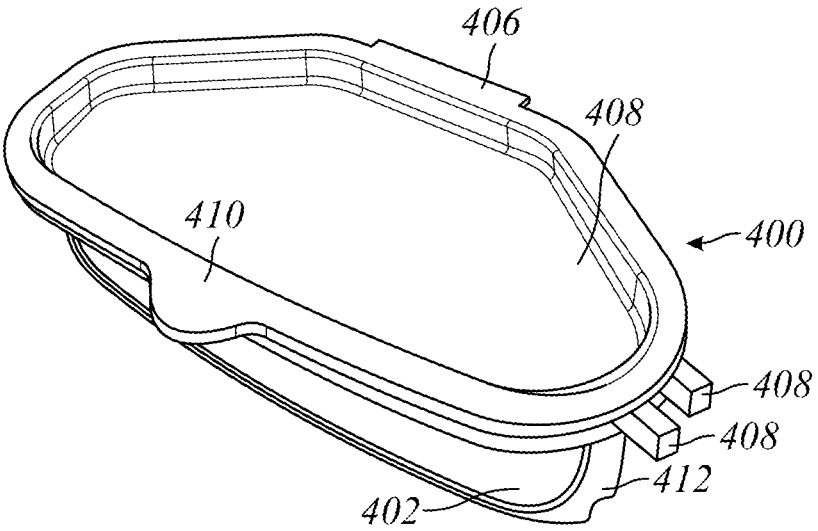
FIG. 11 is a top perspective view of a cup.
Figure 12:
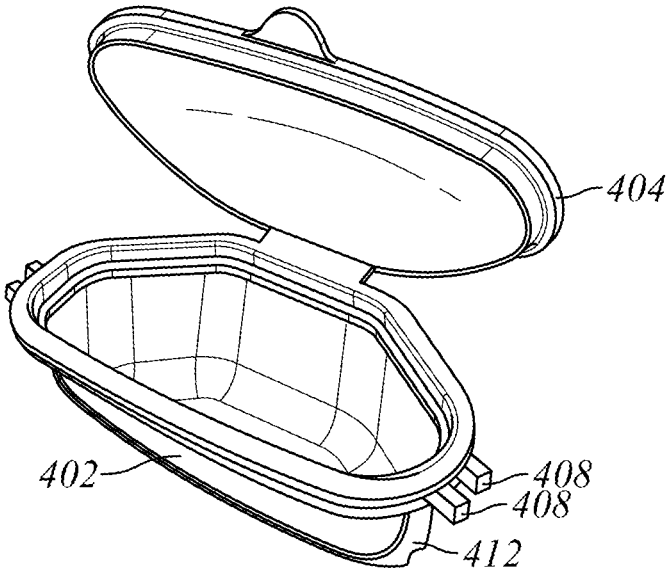
FIG. 12 is a top perspective view of the cup of FIG. 11 with the lid raised.
Figure 13:
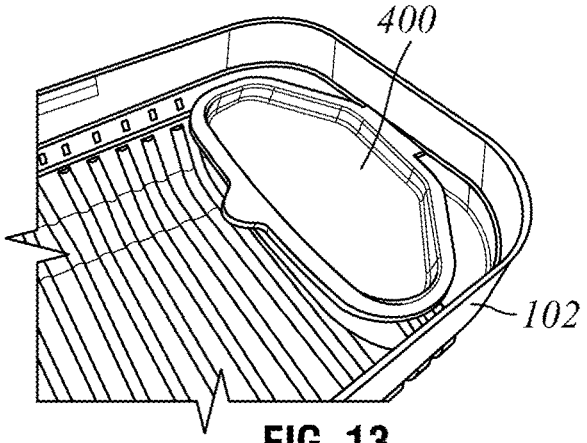
FIG. 13 is a top perspective view of the cup of FIG. 11 in a container.

As shown in FIGS. 11 through 13, other containers such as a cup 400 may be secured within the container, for example to securely hold liquid items such as sauces separate from the other contents of the container and enable easy access to such liquid items. The cup 400 comprises a base portion 402 including a cavity for holding items. A lid 404 is configured to cover the open end of the base portion 402, thereby enabling contents to be sealed within the cup 400. Optionally, a hinge 406 joins the lid 404 to the base portion 402. A thumb tab 410 located opposite the hinge 406 enables the lid 404 to be readily detached from the base portion 402. A plurality of tabs 408 configured to engage with the indentations 114 on the peripheral wall 106 of the base 102 extend from opposite sides of the cup 400, so as to enable the cup 400 to be secured in place within the container 100. A ridge 412 extends from the base portion 402 and is configured to fit within a groove 110 in the base 102 of the container 100 between adjacent ridges 112 so as secure the cup 400 in place. In embodiments, either the tabs 408 or the ridge 412 may be omitted from the cup.

The base portion 102 may be made from a suitable material that is substantially rigid such as glass, plastic, or polycarbonate. The lid 200 may be made from a suitable material that is flexible or semirigid such as rubber, silicone, or the like. In embodiments, either the container 100 as a whole or at least the base portion 102 is made from microwave-safe materials.

Figure 17:
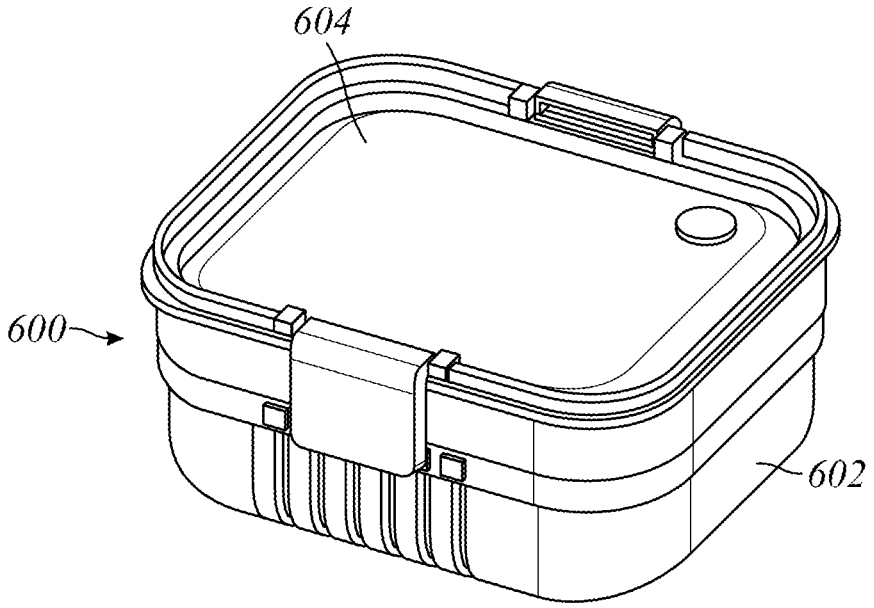
FIG. 17 is a perspective view of a third embodiment of a container.
Figure 18:
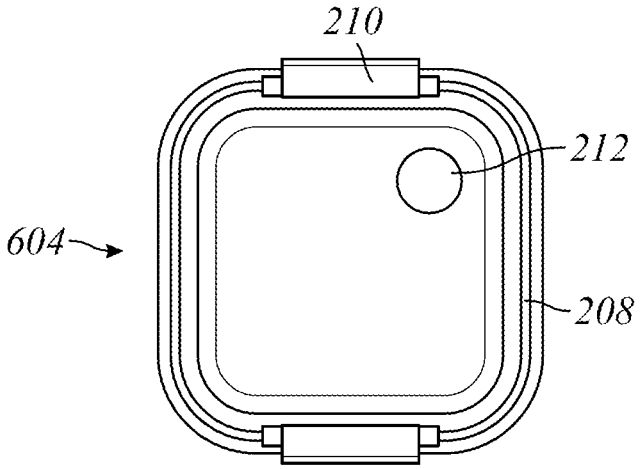
FIG. 18 is a top view of the container of FIG. 17.
Figure 19:
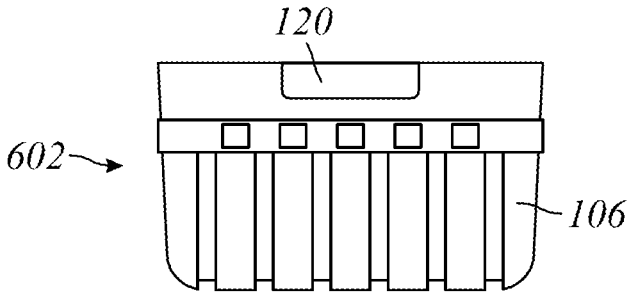
FIG. 19 is a side view of the container of FIG. 17.
Figure 20:
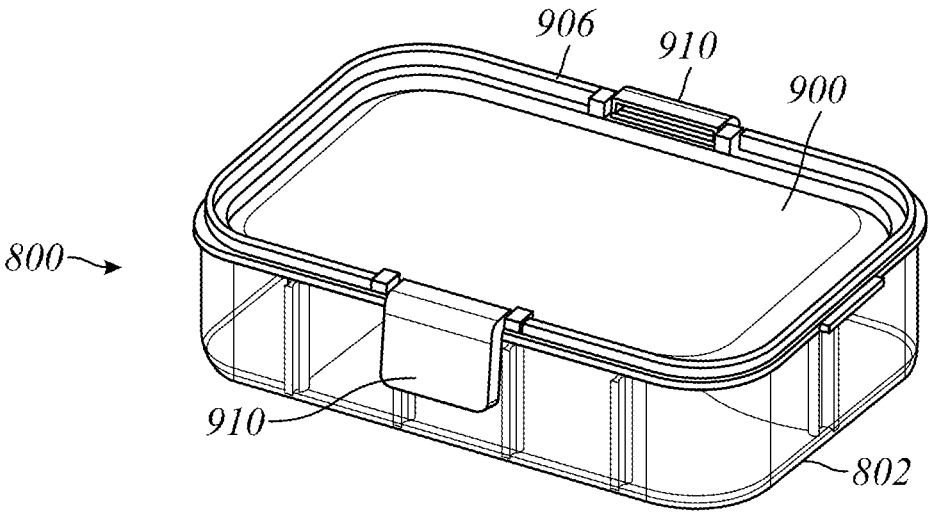
FIG. 20 is a perspective view of a fourth embodiment of a container with a lid.
Figure 21:
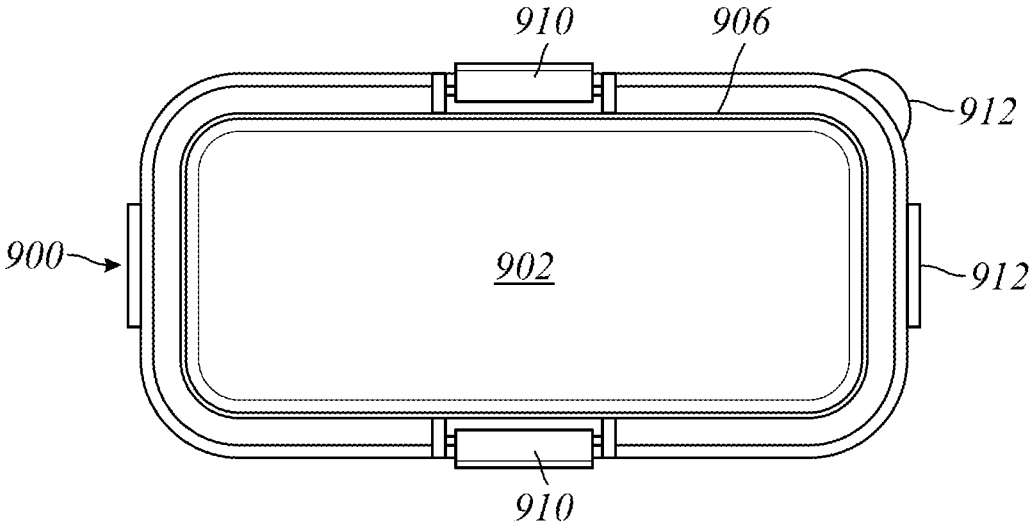
FIG. 21 is a top view of the container of FIG. 20.
Figure 22:
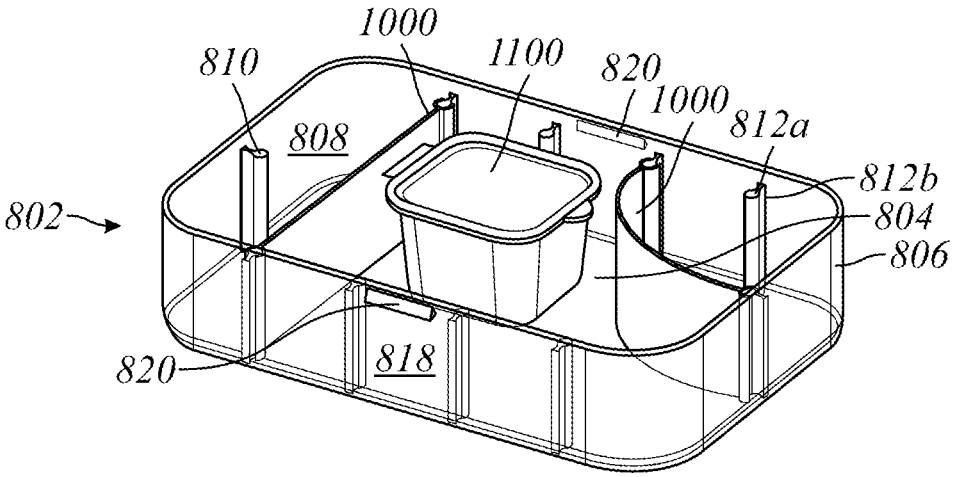
FIG. 22 is a perspective view of the container of FIG. 20 with the lid removed.
Figure 23:
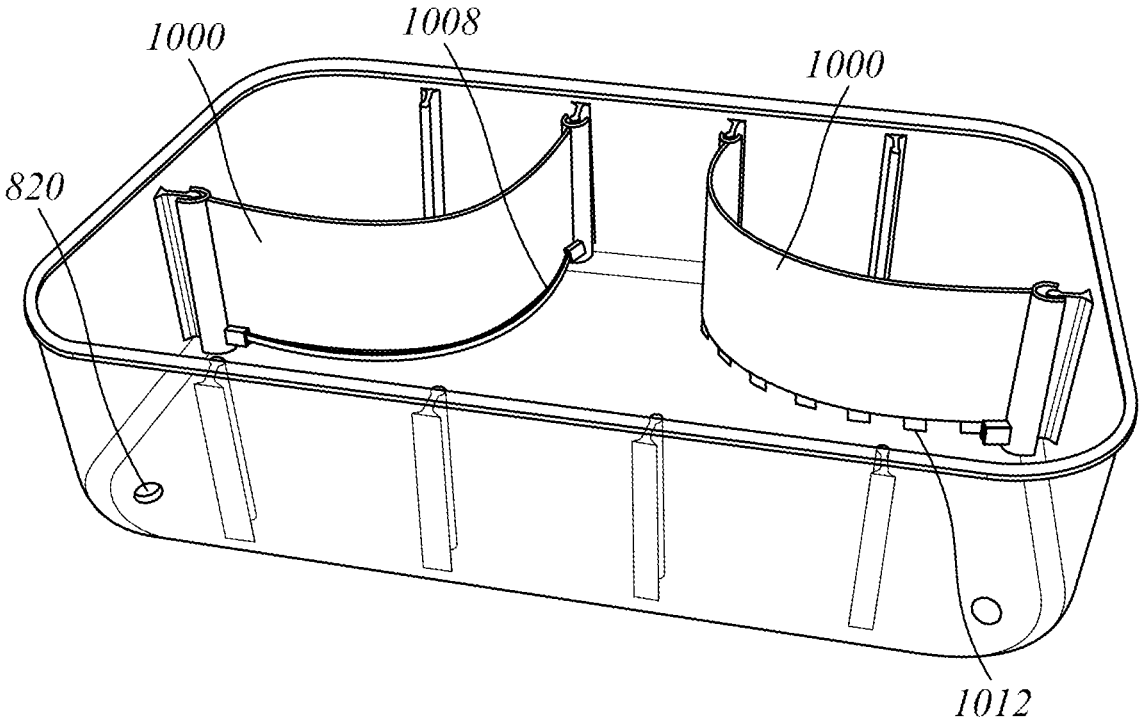
FIG. 23 is a perspective view of the container of FIG. 20 with the lid removed and the dividers in an alternative arrangement.
Figure 24:
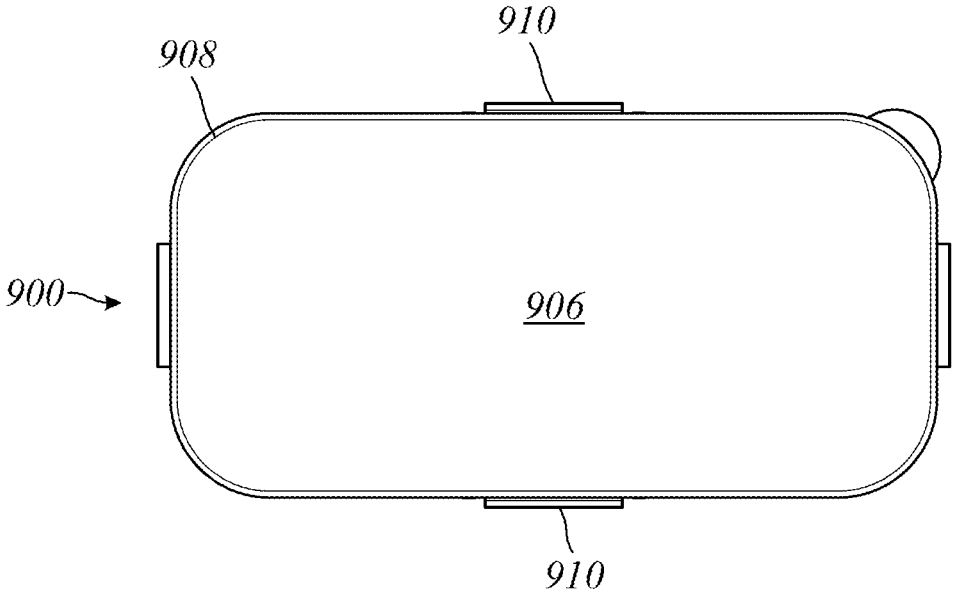
FIG. 24 is a bottom view of the lid shown in FIG. 20.
Figure 25:
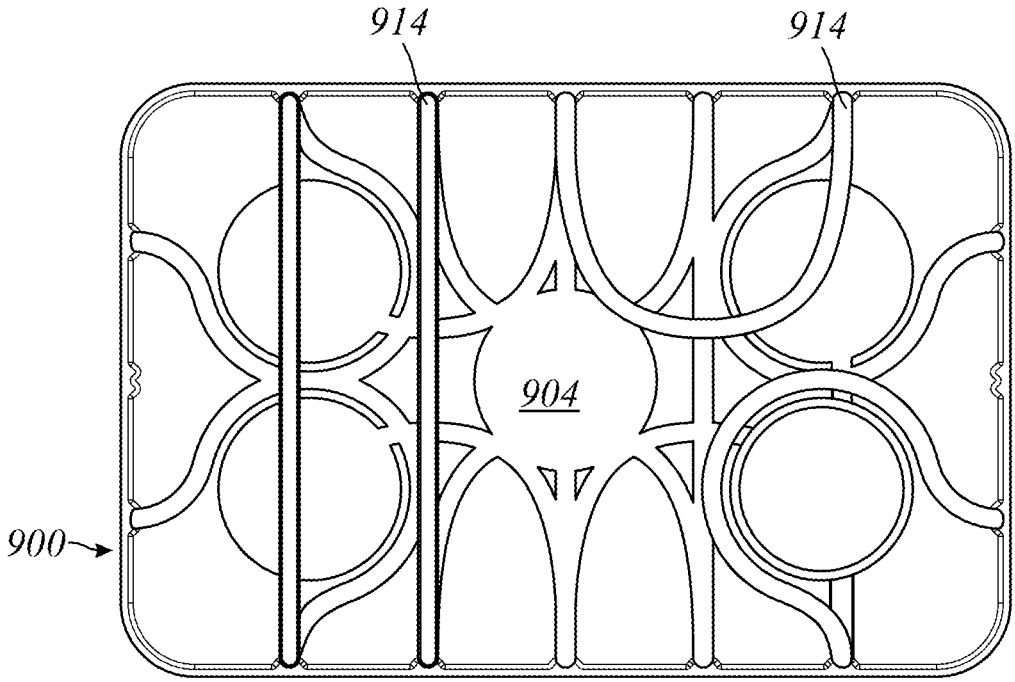
FIG. 25 is a bottom view of an alternative embodiment of a lid for the container shown in FIG. 20.

As shown, viewed from above the base 102 may be generally rectangular in shape with rounded corners. Alternative shapes may also be used, such as squares, circles, or the like. An alternative embodiment featuring a substantially square horizontal cross section is depicted in FIGS. 17 through 19.

Figure 14:
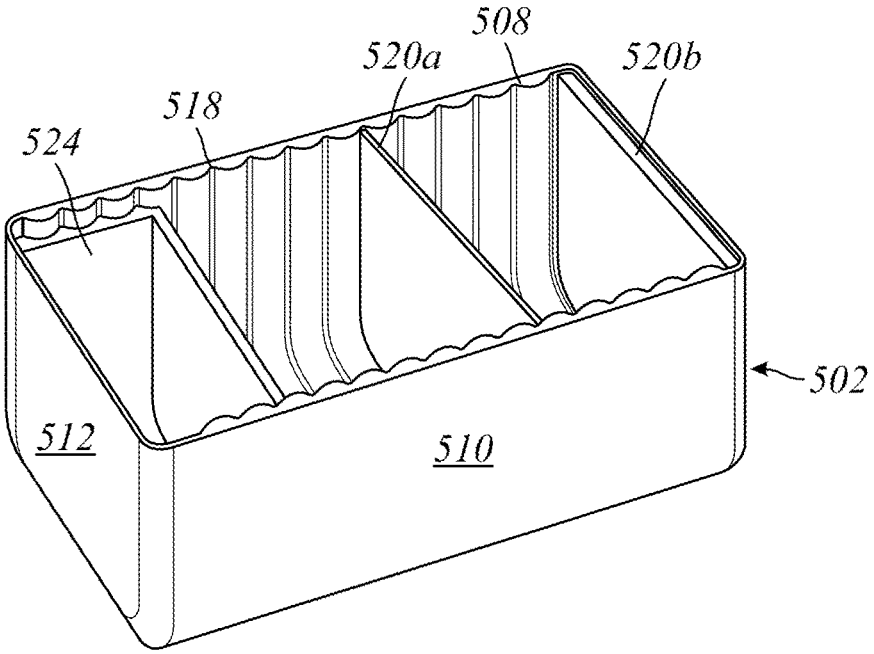
FIG. 14 is a perspective view of a second embodiment of a container.
Figure 15:
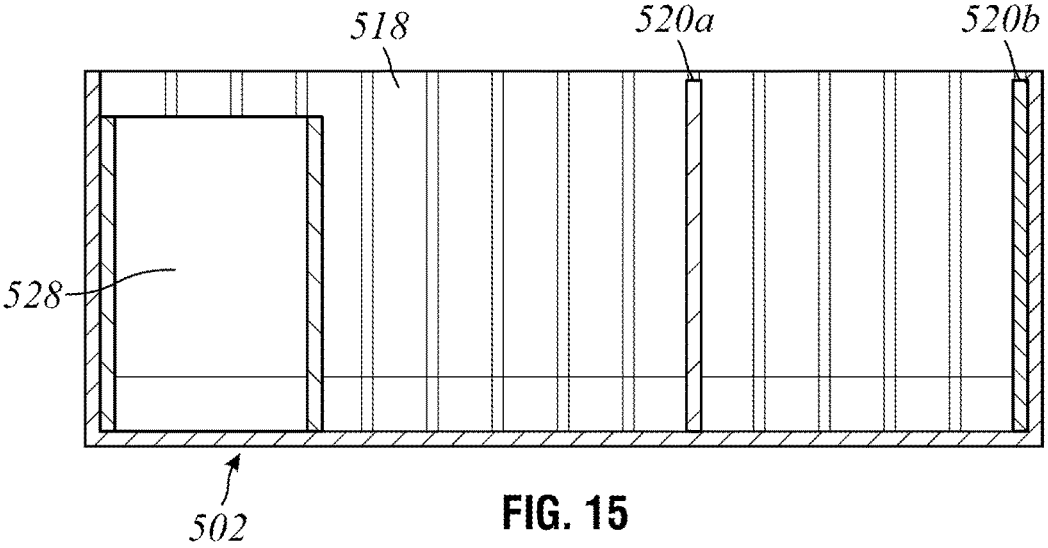
FIG. 15 is a cross-sectional view of the container of FIG. 14.
Figure 16:
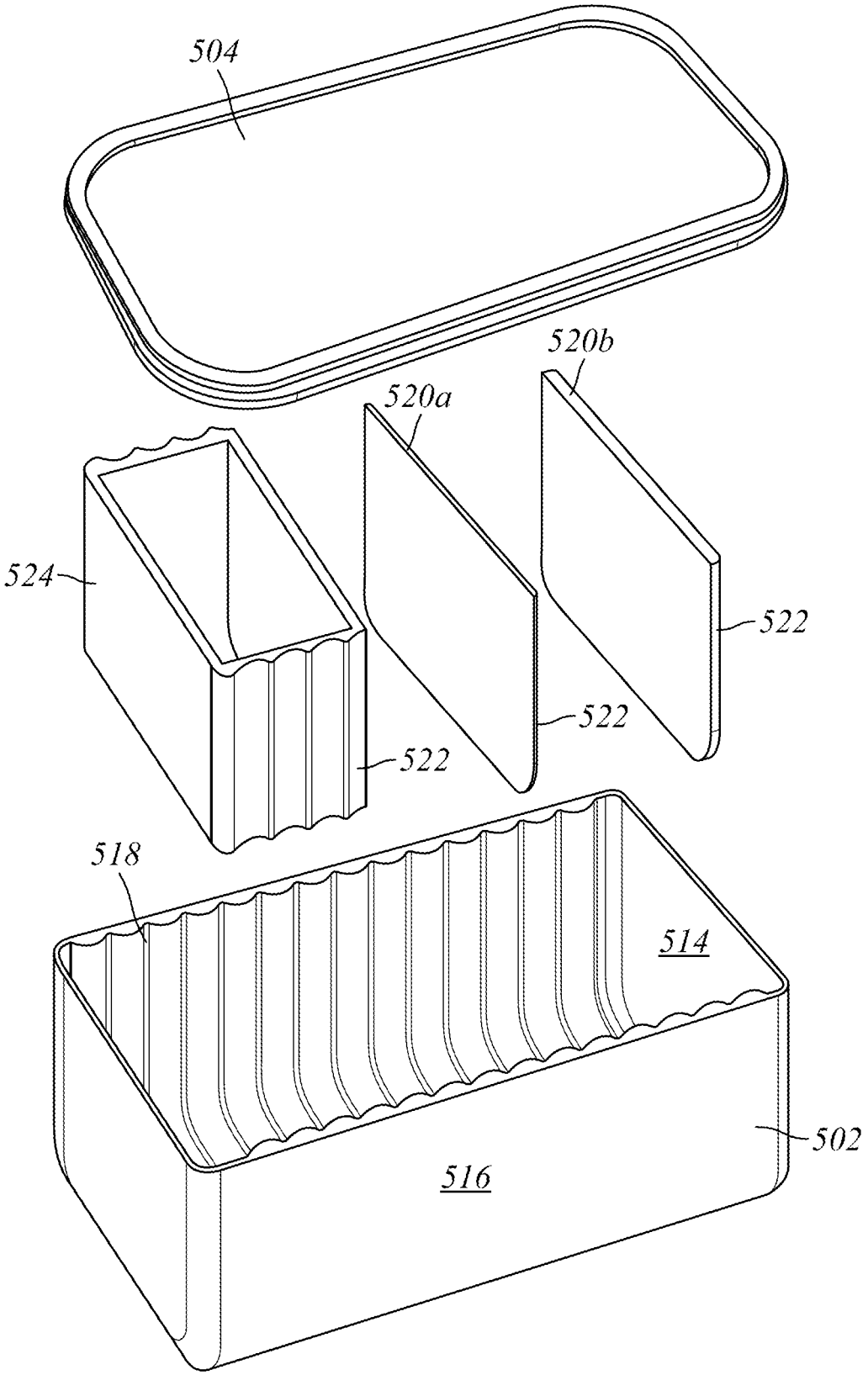
FIG. 16 is an exploded view of the container of FIG. 14.

FIGS. 14 through 16 depict a second embodiment of a container 500. As shown, the container 500 comprises a base 502 and a lid 504 with a plurality of dividers 520. The base comprises a floor 506 and a peripheral wall 508 extending from the floor 506 comprising a pair of opposing side walls 510 and a pair of opposing end walls 512, thereby forming a cavity. The interior surface 514 of the base 502 comprises a plurality of waves 518 stretching along the side walls 510 and the floor 506, while the end walls 512 are substantially flat. Similarly, the exterior surface 516 of the base 502 is substantially flat. Dividers 520*a*, 520*b* may be placed within the cavity. Each divider 520 comprises a perimeter wall 522 that is sized and shaped so as to be complementary to and to interlock with the plurality of waves 518 on the interior surface 514 of the base 502. The dividers 520 may be slid in and out of the container 500 so as to adjust the size and arrangement of compartments within the container 500.

In an embodiment, at least one of the dividers 520 comprises a freezer divider. The freezer divider 520*b* includes a thermal material configured to maintain a desired temperature, such as a freezable gel. For example, the freezer divider 520*b* may be placed in a freezer to cool the thermal material prior to being placed in the container. In an embodiment, thermal material is located proximate a first side of the freezer divider 520*b*, and a layer of insulation is located proximate a second, opposite side of the freezer divider 520*b* such that a first compartment proximate the first side of the freezer divider is maintained at a temperature different than that of a second compartment located proximate the second side of the freezer divider 520*b*. In an embodiment, the base 502 is insulated so as to better maintain a desired temperature within the cavity. Alternatively, at least one of the dividers 520 may comprise a silicone divider 520*a* configured to take up as little space as possible within the container 500.

A tray divider 524 having a plurality of sides that define a tray cavity having an open end facing the lid may also be placed within the cavity. As with the dividers 520, the tray divider 524 includes a perimeter wall 522 that is sized and shaped so as to be complementary to and to interlock with the plurality of waves 518 on the interior surface 514 of the base 502. In an embodiment, the interior surface of the lid 504 also comprises waves 518, such that the lid 504 may interlock with a divider 520. Optionally, the tray divider 524 may include a lid (not shown) configured to interlock with the lid 504 of the container 500. Advantageously, at least a portion of the interior surface of the lid 504 may be configured to engage at least a portion of a top surface of the tray divider 524 to close the tray cavity within the cavity.

FIGS. 20 through 29 depict a third embodiment of a container 800 comprising a base 802 and a lid 900 with one or more dividers 1000.

The base 802 comprises a floor 804 and a perimeter wall 806 extending upward from the floor 804 to define a cavity.

Items to be stored or transported may be placed within the cavity in the base 802. The interior surface 808 of the perimeter wall 806 comprises a plurality of attachment points 810 which extend from the perimeter wall 806. As shown, each attachment point 810 may comprise a rounded terminal portion 812*a* connected to the perimeter wall 806 by a narrow rectangular neck 812*b*. Objects (such as dividers 1000 or cups 1100) to be connected to a first engagement mechanism 810 comprise complementary second engagement mechanisms 1002 configured to engage with first engagement mechanisms 810. In the embodiment shown, the first engagement mechanism comprises an enlarged terminal portion 812*a* and a narrow neck portion 812*b*. The second engagement mechanism 1002 comprises a complimentary structure sized and shaped so as to engulf the terminal portion 812. To connect the engagement mechanisms 810, 1002, the second engagement mechanism is placed above and aligned with the terminal portion 812*a* before being slid down the length of the terminal portion 812*a* until it rests on the floor 804. The second engagement mechanism 1002 can only be removed by lifting it out of the container 800. In alternative embodiments, other complementary structures are used for the engagement mechanisms 810, 1002 such as but not limited to snap-locks or the like. The remainder of the interior surface 808 may be smooth.

The exterior surface 818 of the base 802 may be generally smooth. A plurality of feet 120 may extend away from the exterior surface 818 of the floor 804 of the base 802 so as to support the base 802 above a surface (not shown).

The lid 900 is sized so as enclose the cavity in the base 802. The lid 900 comprises a top surface 902 opposite a bottom surface 904 that are separated by an exterior wall 906. As shown, the exterior wall 906 may extend downwards past the bottom surface 904 so as to form a peripheral ridge 908 configured to engage with the perimeter wall 806 of the base 802 and form an airtight seal. One or more tabs 912 extend away from the lid 900 to enable the lid 900 to be easily detached from the base 802. A gasket may be located on the peripheral ridge 908 so as to contact the perimeter wall 806 when the lid 900 is attached to the base 802. Engagement mechanisms 910 are located on the exterior wall 906 of the lid 900 and are configured to interlock with corresponding receiving portions 820 located on the exterior surface 816 of the perimeter wall 806 of the base, thereby securing the lid 900 to the base 802 and sealing the container 800. As shown, the engagement mechanisms 910 are rotably attached to the lid 900; to lock the lid 900 to the base 802, the lid 900 is pressed firmly against the base 802, causing the gasket to depress. The engagement mechanisms 910 are rotated such that they interlock with the corresponding receiving portions 820, and pressure is removed from the lid 900. To remove the lid 900, the process is reversed: pressure is applied to the lid 900, causing the engagement mechanisms 910 to disengage from the corresponding receiving portions 820. The engagement mechanisms 910 are then rotated away from the receiving portions 820, and pressure is removed from the lid 900. The lid 900 can then be lifted off the base 802. In an alternative embodiment, a gasket is not used, and the lid 900 itself is made from a resilient material capable of deforming to form an airtight seal against the base 802.

Dividers 1000 may be placed in the base 802 so as to form distinct compartments within the cavity. In a preferred embodiment, dividers 1000 are made from a flexible material (such as food-grade silicone) such that compartments of various shapes and sizes may be formed by bending a divider 1000. In an embodiment, the dividers 1000 are made from a semirigid material such that the divider 1000 can be bent but will retain its shape once placed in a configuration. In an alternative embodiment, the dividers 1000 are rigid and can connect only to engagement mechanisms 810 on opposite sides of the base 802. Each divider 1000 includes one or more engagement mechanisms 1002 configured to connect with the engagement mechanisms 810 in the container 800. In the embodiment shown, each engagement mechanism 1002 comprises a semicircular protrusion configured to surround the terminal portion 812*a* of an attachment point 810. In alternative embodiments, other structures are used that allow the divider 1000 to removably engage with attachment points 810 in the container 800. In alternative embodiments, the dividers may be configured to attach to one another, allowing for a greater variety of shapes and arrangements of compartments. In an embodiment, the lid 900 comprises one or more channels 914 on the bottom surface 904 of the lid 900 which are configured to receive an upper edge of the divider 1000, thereby forming a substantially airtight seal between the lid 900, the divider 1000, and the base 802.

Figure 28:
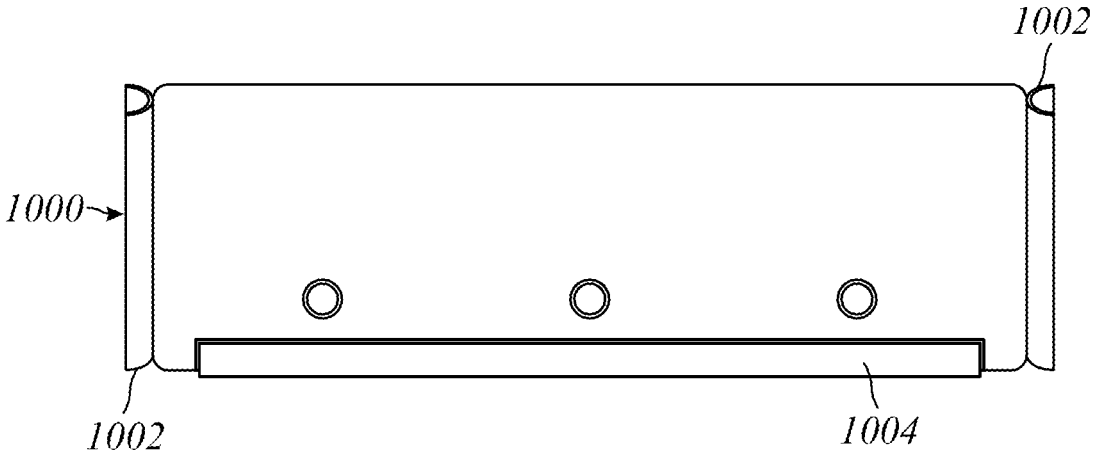
FIG. 28 is a side view of an embodiment of a divider with a flange.
Figure 29:
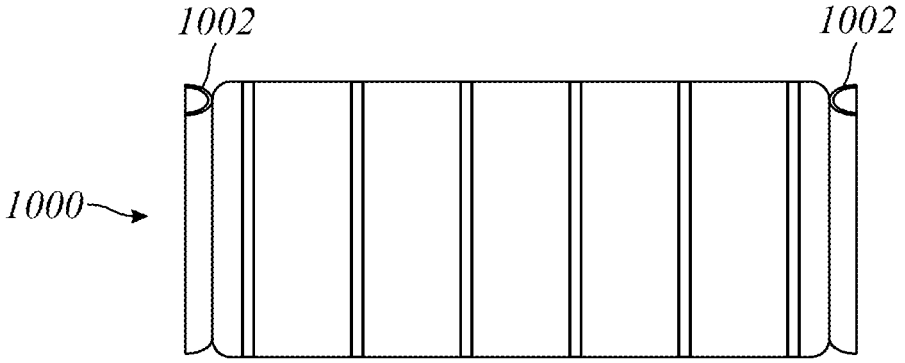
FIG. 29 is a side view of a divider with fold lines.
Figure 30:
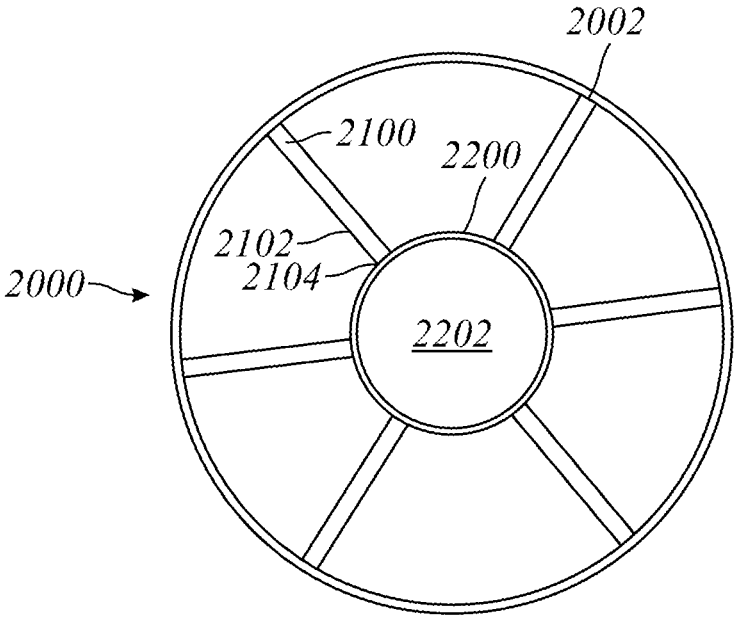
FIGS. 30 through 34 are top views of alternative embodiments of containers and dividers.
Figure 31:
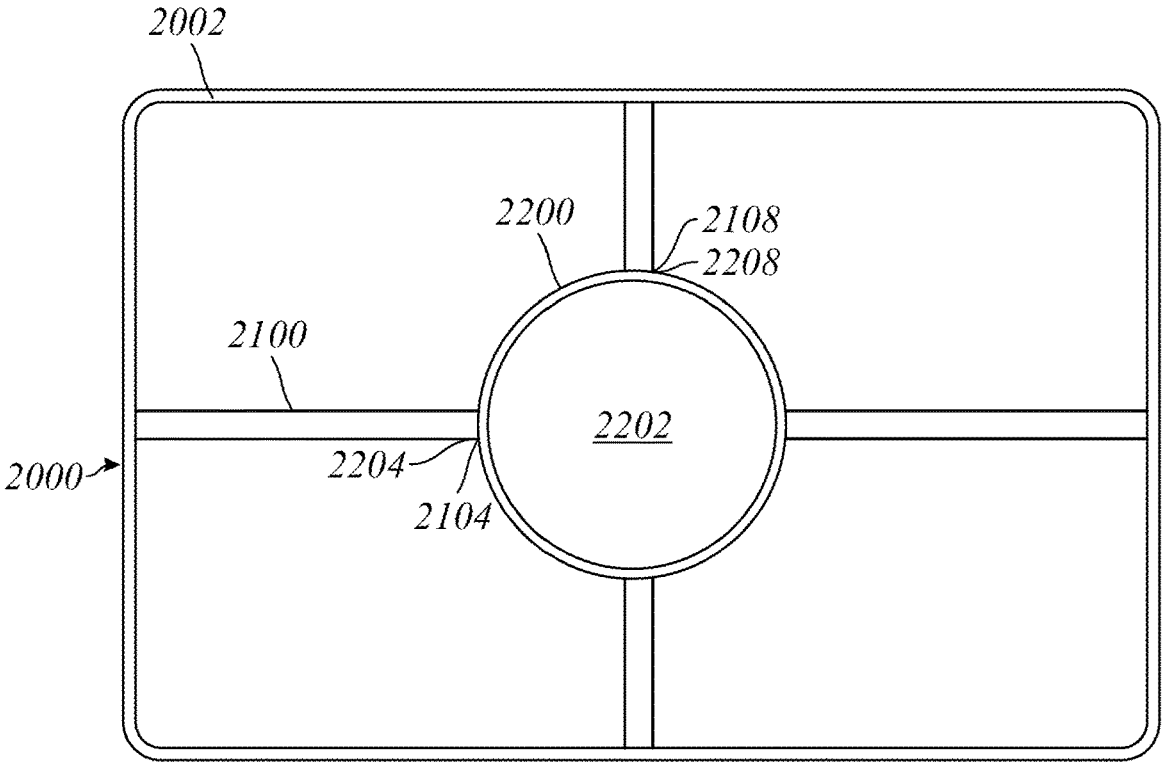
Figure 32:
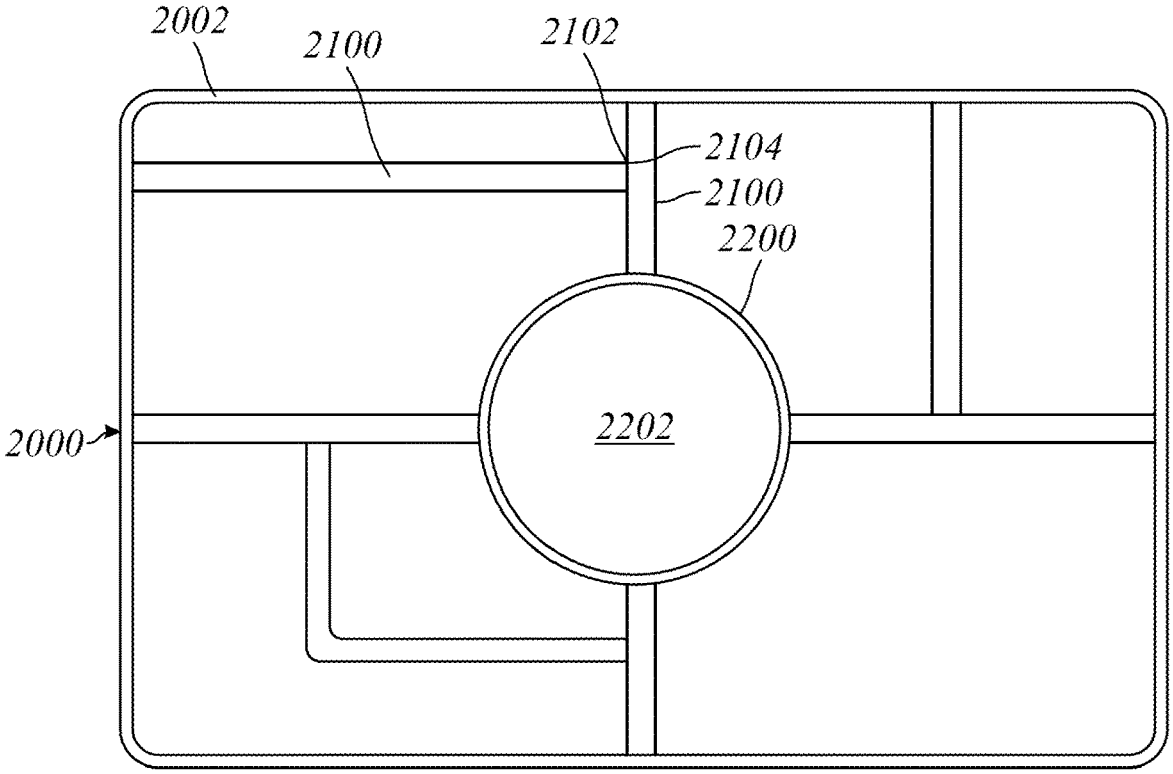
Figure 33:
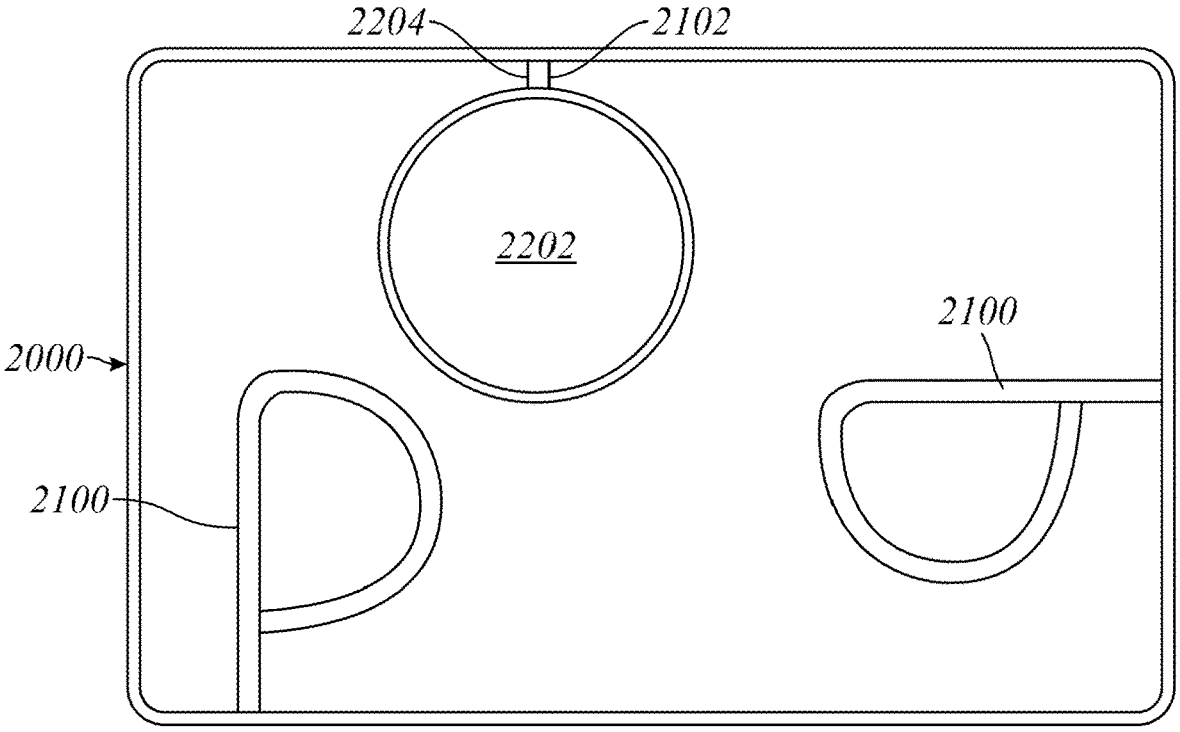
Figure 34:
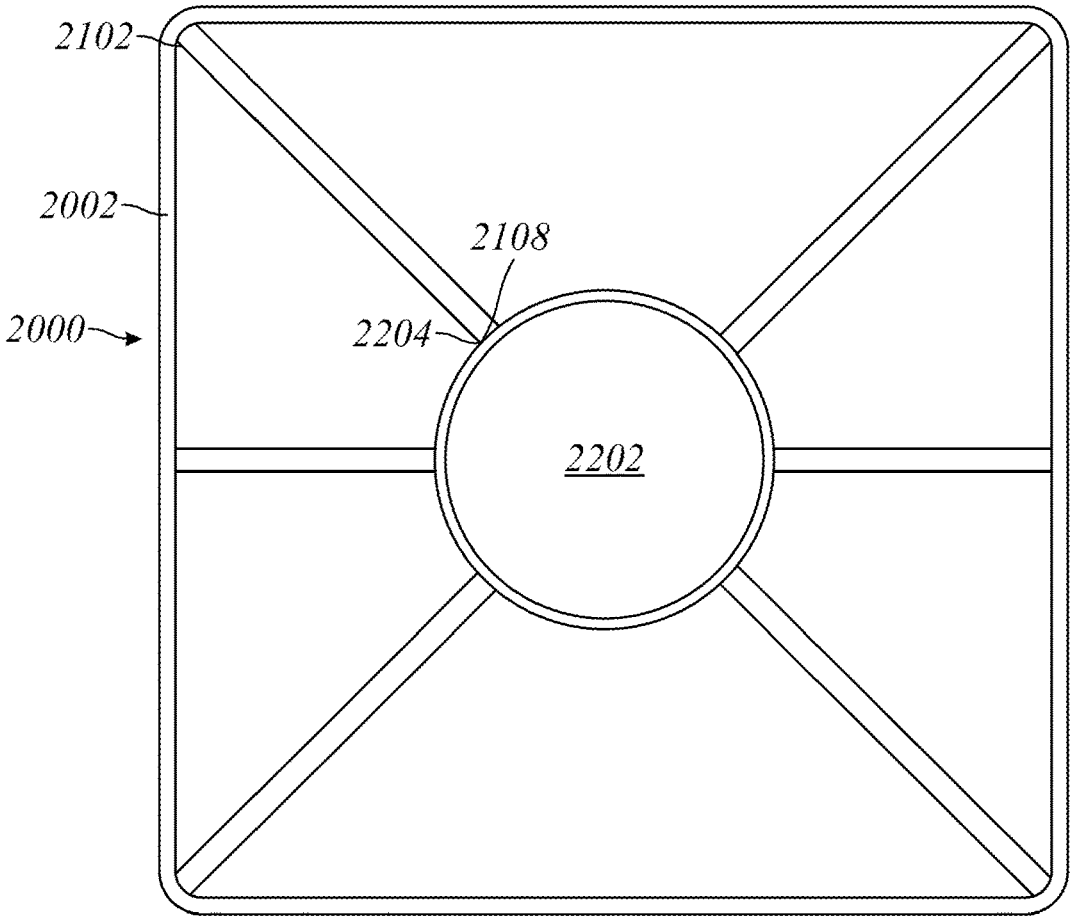

As shown in FIG. 28, a divider 1000 may include a flange 1004 configured to engage with the floor 804 of the base 802 so as to form a leak-proof or leak-resistant seal. The flange 1004 may be formed of over-molded silicon and may be deformable so as to form a watertight seal with the floor 804. As shown in FIG. 29, in an embodiment, a divider 1000 may include one or more fold lines 1006 to enable the divider to more easily bend along the folds 1006. The portions of the divider 1000 between the folds 1006 may be formed from a rigid or semirigid material, while the fold lines 1006 are formed from a pliable material capable of bending. The fold lines may be pre-molded or scored on the divider. In an alternative embodiment, one or more feet 1012 extend away from the divider 1000 to support the divider against the floor 804.

Figure 26:
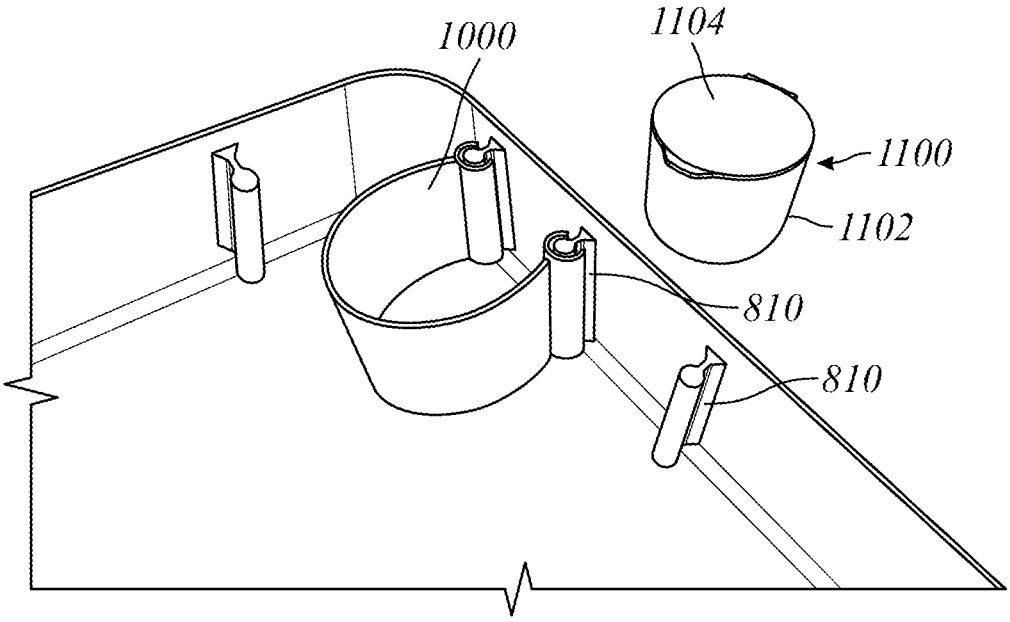
FIG. 26 is a perspective view of the container of FIG. 20 and a cup.
Figure 27:
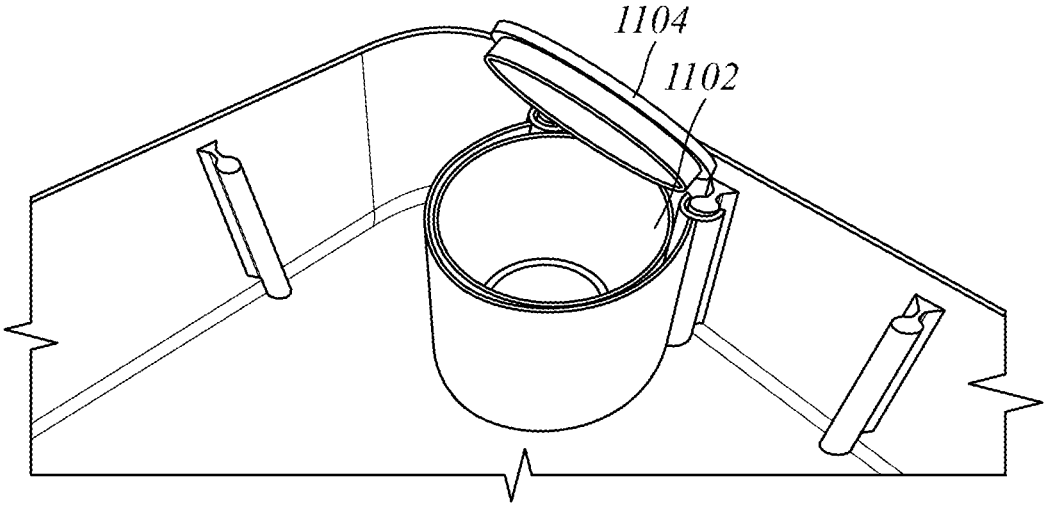
FIG. 27 is a perspective view of the container and cup of FIG. 26 with the cup in the container.

As shown in FIGS. 26 and 27, a cup 1100 may be used within the container 800 to hold sauces or liquids. The cup 1100 is a discrete item that may be removed from the container 800. The cup 1100 comprises a base 1102 and a lid 1104, with a cavity formed in the base 1102 to hold items. The cup 1100 may be secured within the container 800 may attaching a divider 1000 to adjacent attachment points 810, thereby forming a rounded compartment for the cup 1100.

As shown, for example in FIGS. 30 through 34, in embodiments, at least one of the one or more dividers 2100 include a first engagement mechanism 2102 configured to engage with a second engagement mechanism 2104 of a different divider 2100 or itself within a container 2000. For example, a first divider may be connected to a second divider instead of being connected to a perimeter wall 2002 of the container 2000. This arrangement allows for additional flexibility in the configuration of the container into different compartments. Additionally, a single divider may connect to a perimeter wall and also connect back to itself to form the shape of a number 6 or 9 in a peninsula fashion.

In alternative embodiments, the container 2000 further includes a compartment cavity 2200 comprising a plurality of sides that define a cavity 2202. The compartment cavity 2202 is removable from the container, and at least one external surface of one of the plurality of sides of the compartment cavity 2202 includes a first engagement mechanism 2204 that is configured to engage with a second engagement mechanism of a divider 2104. For example, a circular-shaped compartment cavity 2202 may have a plurality of first engagement mechanisms 2204 on its external surface, and there may be a plurality of dividers 2100 that have a first end engaged with the internal surface of the perimeter wall 2002 of the container 2000 and a second end engaged with first engagement mechanisms 2204 on the external surface of the compartment cavity 2202.

It is understood that the preceding is merely a detailed description of some examples and embodiments of the present invention and that numerous changes to the disclosed embodiments may be made in accordance with the disclosure made herein without departing from the spirit or scope of the invention. The preceding description, therefore, is not meant to limit the scope of the invention but to provide sufficient disclosure to allow one of ordinary skill in the art to practice the invention without undue burden. It is further understood that the scope of the present invention fully encompasses other embodiments that may become obvious to those skilled in the art and that the scope of the present invention is accordingly limited by nothing other than the appended claims.

What is claimed is:

1. A container system comprising:

a container comprising:

a base wall;

a peripheral wall extending from the base wall to form a cavity, the peripheral wall comprising a first side separated from a second side by the cavity and a top edge opposite the base wall;

a pair of ridges separated by a groove, the pair of ridges and the groove extending from at least a first portion of the first side of the peripheral wall proximate the base wall, across the base wall, and to at least a second portion of the second side of the peripheral wall proximate the base wall; and a first indentation located on the first side of the peripheral wall and a second indentation located on the second side of the peripheral wall; and a divider comprising an edge, the edge sized so as to fit within the groove between the pair of ridges;

a first tab configured to be inserted into the first indentation;

a second tab configured to be inserted into the second indentation; and a resilient material disposed along at least a portion of the edge such that the resilient material contacts the base wall when the edge is placed between the pair of ridges.

2. The container system of claim 1, further comprising a lid configured to removably attach to the top edge of the peripheral wall so as to seal the cavity.

3. The container system of claim 2, wherein the lid further comprises an upper surface, a lower surface, a hole extending between the upper surface and the lower surface, and a vent, the vent comprising an upper section located above the upper surface, a lower section located below the lower surface, and a transverse section extending between the upper section and the lower section through the hole.

4. The container system of claim 3, wherein the vent further comprises a channel extending from the lower section along at least a portion of the transverse section.

5. The container system of claim 4, wherein the vent is movable from a closed position whereby the upper section is proximate the upper surface of the lid and an open position wherein the lower section is proximate the lower surface of the lid.

6. The container system of claim 2, the lid further comprising:

a lower peripheral ridge located along the perimeter of the lid extending away from the lower surface, the lower peripheral ridge sized to engage with the peripheral wall; and a gasket proximate the ridge, such that with the lid attached to the top edge of the peripheral wall, the gasket is compressed between the lid and the peripheral wall.

7. The container system of claim 2, the lid further comprising:

an upper peripheral ridge along the perimeter of the lid extending away from the upper surface; and a strap extending across the lid from a first side of the upper peripheral ridge to a second side of the upper peripheral ridge, the strap configured to secure an item between the strap and the upper surface of the lid.

8. The container system of claim 2, wherein the lid further comprises an lid groove separating a pair of lid ridges, the lid groove and pair of lid ridges extending across at least a portion of a bottom surface of the lid located proximate the container and sized to receive the edge of the divider therein when the lid is attached to the container.

9. The container system of claim 1, wherein the divider further comprises a thermal material configured to be heated or cooled to a desired temperature.

10. The container system of claim 9, further comprising a cup comprising at least a lower portion removably attached to an upper portion with a hollow space located therebetween, the lower portion comprising a protrusion sized so as to fit within the groove between the pair of ridges to secure the cup to the container.

11. A method for using a container system comprising:

a container comprising a base wall, a peripheral wall comprising a first side opposite a second side extending from the base wall to a top edge and forming a cavity, a first plurality of indentations located on the first side of the peripheral wall, and a second plurality of indentation located on the second side of the peripheral wall, a lid configured to attach to the top edge to seal the cavity, and a plurality of dividers each comprising a first face, a second face, a rim extending therebetween, a first tab, a second tab, and a gasket disposed along at least a portion of the rim, the method comprising the steps of:

aligning a first divider of the plurality of dividers with a first indentation of the first plurality of indentations and a second indentation of the second plurality of indentations;

inserting the first divider into the cavity;

connecting the first tab of the first divider to the first indentation of the first plurality of indentations and a second tab of the first divider to the second indentation of the second plurality of indentations, thereby forming a first compartment within the cavity between the peripheral wall and the first divider;

aligning a second divider of the plurality of dividers with a third indentation of the first plurality of indentations and a fourth indentation of the second plurality of indentations;

inserting the second divider into the cavity;

connecting the first tab of the second divider to the third indentation of the first plurality of indentations and the second tab of the second divider to the fourth indentation of the second plurality of indentation, thereby forming a second compartment within the cavity between the first divider, the peripheral wall, and the second divider and forming a third compartment within the cavity between the peripheral wall and the second divider; and placing the lid on the container, such that the lid contacts the top edge, the first divider, and the second divider.

12. The method of claim 11, wherein the gasket of the first divider is configured such that when the first divider is inserted into the cavity, the first tab of the first divider is connected to the first indentation of the first plurality of indentations, and the second tab of the first divider is connected to the second indentation of the second plurality of indentations, the gasket is compressed to form a substantially watertight seal with at least a first portion of the base wall and at least a second portion of the peripheral wall.

13. A container system comprising:

a container comprising:

a base wall;

a peripheral wall extending from the base wall to form a cavity, the peripheral wall comprising a first side extending from a first edge of the base wall and a second side extending from a second edge of the base wall, wherein the first edge is opposite the second edge;

a first indentation located on the first side of the peripheral wall and a second indentation located on the second side of the peripheral wall; and a divider, the divider comprising:

a first face, a second face, and a rim extending therebetween;

a first raised wall extending from the rim proximate the first face;

a second raised wall extending from the rim proximate the second face;

a channel formed on the rim between the first raised wall and the second raised wall;

a first tab configured to be inserted into the first indentation;

a second tab configured to be inserted into the second indentation; and a gasket located in the channel.

14. The container system of claim 13, wherein, with the first tab inserted into the first indentation and the second tab inserted into the second indentation, a first portion of the gasket is compressed against the base wall and a second portion of the gasket is compressed against the peripheral wall.

15. The container system of claim 14, the container system further comprising a lid configured to removably attach to the peripheral wall;

wherein, with the lid attached to the peripheral wall, the first tab inserted into the first indentation, and the second tab inserted into the second indentation, a third portion of the gasket is compressed against the lid.

16. The container system of claim 15, wherein, with the lid attached to the peripheral wall, the first tab inserted into the first indentation, and the second tab inserted into the second indentation, the divider forms a seal with the base wall, the peripheral wall, and the lid such that a first portion of the cavity proximate the first face of the divider is separated from a second portion of the cavity proximate the second face of the divider.

17. A container system comprising:

a container comprising:

a base wall;

a peripheral wall extending from the base wall to form a cavity, the peripheral wall comprising a first portion located on an opposite side of the base wall from a second portion;

a first indentation located on the first portion of the peripheral wall and a second indentation located on the second portion of the peripheral wall; and a divider, the divider comprising:

a first face, a second face, and a rim extending therebetween;

a first tab configured to be inserted into the first indentation;

a second tab configured to be inserted into the second indentation; and a gasket extending along at least a portion of the rim.

18. The container system of claim 17, wherein, with the first tab inserted into the first indentation and the second tab inserted into the second indentation, a first portion of the gasket is compressed against the base wall and a second portion of the gasket is compressed against the peripheral wall.

19. The container system of claim 18, the container system further comprising a lid configured to removably attach to the peripheral wall;

wherein, with the lid attached to the peripheral wall, the first tab inserted into the first indentation, and the second tab inserted into the second indentation, a third portion of the gasket is compressed against the lid.

20. The container system of claim 15, wherein, with the lid attached to the peripheral wall, the first tab inserted into the first indentation, and the second tab inserted into the second indentation, the divider forms a seal with the base wall, the peripheral wall, and the lid such that a first portion of the cavity proximate the first face of the divider is separated from a second portion of the cavity proximate the second face of the divider.

* * * * *